United States Patent [19]

DuForest et al.

[11] Patent Number: 4,675,216

[45] Date of Patent: Jun. 23, 1987

[54] PROCESS AND APPARATUS FOR PRODUCING SYNTHETIC DECORATIVE COVERING

[75] Inventors: Rene DuForest, Montcy Notre Dame, France; Albert Roussel, Wiltz, Luxembourg

[73] Assignee: Sommer S.A., Luxembourg

[21] Appl. No.: 588,857

[22] Filed: Mar. 12, 1984

[30] Foreign Application Priority Data

Mar. 11, 1983 [LU] Luxembourg ..... 84688

[51] Int. Cl.[4] ..... B05D 3/06; B05D 5/06; B05D 5/00; B05D 19/00

[52] U.S. Cl. ..... 427/56.1; 118/301; 118/308; 118/310; 427/195; 427/197; 427/199; 427/201; 427/203; 427/205; 427/346

[58] Field of Search ..... 427/197, 199, 201, 346, 427/203, 195, 205, 56.1; 118/301, 308, 310; 428/204

[56] References Cited

U.S. PATENT DOCUMENTS 4,076,567 2/1978 Yoshikawa et al. ..... 427/201 X
4,209,553 6/1980 Greenberg ..... 118/308 X

FOREIGN PATENT DOCUMENTS 595145 1/1978 Switzerland .
1087560 10/1967 United Kingdom .

OTHER PUBLICATIONS

"Webster's Seventh New Collegiate Dictionary," Springfield, Mass., G&E Merriam Company, 1967, p. 774.

*Primary Examiner*—Evan K. Lawrence
*Attorney, Agent, or Firm*—Fishman & Dionne

[57] ABSTRACT

A process and apparatus for manufacturing synthetic decorative coverings is presented in which at least one powder (generally a polymeric resin) is selectively deposited, in accordance with a pattern or decoration, onto a base material. The power deposition is carried out under gravity without contact between the means of applying the powder and the base. At least one of the deposited powders contains particles which are fusible at a temperature below the distortion temperature of the base and which is compatible with the base material. At least one thermal treatment is then carried out at a temperature below the distortion temperature of the base so as to fix the decorative pattern produced by deposited powders. The apparatus for applying the powders consists of a continuous screen printing frame, in particular, a screen printing roller which is fed by a device providing uniform distribution of the powder into a hopper located inside the roller. The hopper has two longitudinal blades which are adjustably separated and are in contact with the inner surface of the screen.

37 Claims, 4 Drawing Figures

PROCESS AND APPARATUS FOR PRODUCING SYNTHETIC DECORATIVE COVERING

BACKGROUND OF THE INVENTION

This invention relates to the field of synthetic decorative coverings. More particularly, this invention relates to an apparatus and process for manufacturing synthetic decorative coverings and the products obtained thereby. It should be appreciated that "synthetic coverings" may be any coverings produced from organic components which may, if appropriate, include inorganic materials in their formulations (for example, asbestos or glass voile) or other organic materials of plant origin (i.e., jute).

The manufacture of products for synthetic decorative coverings, particularly for floors and walls, which are based on synthetic materials, usually polyvinylchloride (PVC), has been the subject of major devèlopments in recent decades. Typically, these synthetic decorative coverings consist of a base material, such as, for example, jute fibers, asbestos, nonwoven glass fibers, synthetic foam or the like. Next, a sheet or layer of PVC is applied to the base. Finally, the face of the PVC receives a desired decoration or pattern and which thereafter, is usually protected by a transparent film covering.

A plurality of alternative methods fòr producing such decorative coverings have been utilized. However, all of these alternative processes relate to printing techniques which use a relatively viscous liquid product. Another technique, also derived from printing techniques, consists of localized application of plastisol studs by screen printing.

Because printing products are commonly used in the above discussed alternative processes, a pasty printing ink is also utilized in conjunction with these techniques. This ink is typically comprised, in part, of a liquid, i.e., water or solvent.

Generally, in order to produce the final decorative surface, known processes involve several successive applications, via printing techniques, of various components of the decoration. Each printing application requires a drying step after which, a transparent protective covering is employed.

It will be appreciated to those skilled in the art, that the above processes provide only mediocre results, particularly when attempting to imitate ceramic glazes such as floor tiling or wall tiling. Various improvements in the above processes, involving the use of foaming agents in conjunction with simultaneous and localized application of chemicals which retard or accelerate foaming, have been proposed in an effort to produce a localized expansion (for example, see FR-A No. 1,411,338). However, even in this French patent, it has been found that while the geometrical configuration and appearance of the tiling can be accurately reproduced, the surface conditions peculiar to glazed products is reproduced only sporadically and the appearance of a depth (also peculiar to these ceramic products) is not achieved.

Patents DE-A No. 2,260,788 and FR-A No. 2,263,893 disclose "handicraft" processes for producing patterns by the deposition of fusible substances on a base made of metal, glass, ceramic or of any other material which is stable at the temperature for carrying out the subsequent thermal treatment. These processes are intended for use in the non-continuous production of colored patterns in the form of, for example, tourist souvenirs or the like.

Patent FR-A No. 74/37,741 describes a process for printing textile surfaces, particularly deep pile materials, wherein coloring products having a powdered form are applied to the surface which is to be printed in accordance with a corresponding decorative design. A portion of the colored product is then fixed. Any particles which were not fixed are subsequently removed. This French patent relates solely to textile surfaces and does not in any way teach or suggest a process for providing a covering which imitates the glazing effects generally obtained with ceramic materials. To the contrary, the printing process described in FR-A No. 74/37,741 relates to depositing a dye on a piled textile by a technique involving disposing powdered colorants in the interstitial spaces of the textile fibers. It will be appreciated that this process essentially depends on the base material and the preparation thereof. The purpose of the process is to provide a final decorative effect which is restricted to introducing coloring into textile fibers without providing any three dimensional effects.

Prior art patent CH-A No. 595,145 discloses the deposition of powders through a screen printing frame which is in contact with the base material by means of a magnetic doctor blade. The technique of this patent does not permit a variable volume of powders to be disposed on the base.

Finally, a process suggested by Patents FR-A No. 2,291,868 and FR-A No. 2,210,148, involves the fixation of particles, fibrils or powders, under the effects of an electrostatic field onto a base coated with an adhesive material.

It should be understood to those skilled in the art that the above discussed techniques and processes are not applicable in any satisfactory way to the manufacture of flexible multilayer decorative coverings for floors and walls having requirements which include, for example, high resistance to delamination and other stresses.

SUMMARY OF THE INVENTION

The above discussed and other problems of the prior art are overcome or alleviated by the process and apparatus of the present invention. In accordance with the present invention, a novel process is presented for producing synthetic decorative coverings having an appearance which is very similar to ceramics and other glazed coverings. These highly desirable ceramic-like decorative coverings are achieved by a process for manufacturing synthetic decorative coverings wherein at least one polymeric powder, typically a thermoplastic resin, is selectively deposited, in accordance with a pattern or decorative design, onto a base material. A novel feature of this invention is that the deposition of powder is carried out under gravity in the absence of contact between the means for applying the powder and the base. Preferably, the powders are deposited via a continuous screen printing frame, particularly a rotary screen printing frame. In accordance with the present invention, at least one of the deposited powders contains particles which are fusible at a temperature below the distortion temperature of the base material. These powders should be compatible with that of the base or at least close to the distortion temperature of the base. Also, in accordance with the present invention, at least one thermal treatment is carried out at a temperature below the distortion temperature of the base thereby fixing the pattern or decorative design which has been produced by the deposited powders.

The fixation of the design or pattern onto the base is preferably, at least partially achieved by a co-fusion of the powder and the base material. It will be appreciated that co-fusion is defined as a homogeneous imbrication of the pattern with the base during the thermal treatment. The co-fusion being sufficent to prevent delamination. Thus, during the thermal processing mentioned above, the deposited powder should penetrate at least partially into the interior of the base material.

Surprisingly, it has been found that the process and apparatus in accordance with the present invention provides products which are flexible and capable of being rolled, while also having a remarkable ceramic-like asthetic appearance along with good mechanical and wear properties suitable for covering floors and walls. These desirable results are obtained moreover, without the use of lining techniques, which are conventionally employed in plastics processing and which generally involve a combination of mechanical pressure and heat, i.e., calendering.

In an alternative method of the present invention, the powder may be deposited onto a temporary intermediate base on which the thermal treatment is performed. Thereafter, the deposited powder maybe transferred to the above mentioned final base material.

Thus, unlike the prior art, the present invention does not utilize conventional printing techniques in an effort to form decorative designs or patterns on the coverings, but instead, the present invention provides a novel method for applying powders and producing a three dimensional configuration. The present invention insures strong adhesion of the decorative components for a variety of floor and wall coverings heretofore not found in the prior art.

The present invention permits the imitation of those desired colors and textures which are obtained by producers of ceramics through the use of powders which appear as ceramic glazes and enamals. The present invention also provides desirable mixing and spreading effects which also appear similar to (i.e., imitate) ceramic glazed products. Moreover, varying the method of applying the powder makes it possible to produce decorative designs of all types such as, for example, abstract patterns or those conventional patterns typically found in the decorative covering field.

In accordance with the present invention, the method of powder deposition "without contact" between the powder applying means and the base offers numerous advantages over conventional prior art printing processes.

Thus, the process of the invention can be employed on any type of base material which is compatible with the powder employed or which is treated beforehand to make it compatible with the powder, (examples of which were mentioned earlier in the Background of the Invention). Moreover, those bases having uneven surfaces (deep reliefs), for example, as a result of a prior layer having been applied in a conventional process, may be utilized by the present invention. Furthermore, rigid organic or inorganic bases made compatible with the particular powder employed may also be used. Note that, as a result of the choice of the base material and of the powder applied, the products of the present invention may be flexible (rollable) and yet have an appearance resembling rigid ceramics. The novel decorative coverings of the present invention can be produced continuously and in strips capable of being rolled. The base material may be reinforced if desired. However, it should be understood that the base material must have a stability, including dimensional stability, which is sufficient at the temperature in which the powders are thermally treated.

Another advantage of the "without contact" method and apparatus of the present invention is the capacibility of superimposing various layers of powders without, however, having to even partially fix the preceding layer or layers. This makes it possible to obtain the desired ceramic-like characteristics due to the mutual interpenetration or imbrication of the layers. This advantage, moreover, also provides considerable economic savings due to the elimination of the usually thermal fixing treatments carried out between depositions. Thus, only a single "final" thermal treatment is necessary with the present invention. Consequently, energy is further saved by use of only a single oven which is kept continuously hot. Energy is also saved by the avoidance of successively heating and cooling the decorative covering product during manufacture. It will be appreciated that to achieve certain special ceramic-like characteristics, it may nevertheless be advantageous to provide intermediate fixing operations between two successive applications of powders.

The above discussed and other advantages of the present invention will be apparent to and understood by those skilled in the art from the following detailed description and drawings.

BRIEF DESCRIPTION OF THE DRAWINGS

Referring now to the drawings wherein like elements are numbered alike in the several FIGURES.

DESCRIPTION OF THE PREFERRED EMBODIMENT

Figure 1:
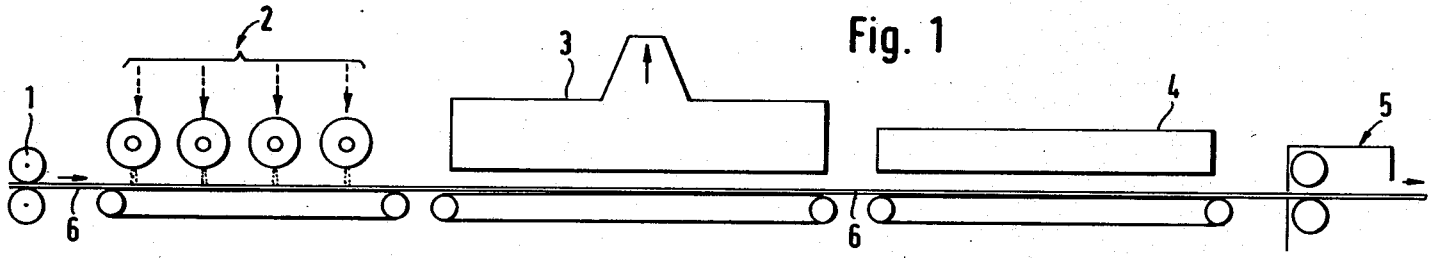
FIG. 1 is a diagrammatic view of an apparatus for carrying out the process in accordance with the present invention.

In accordance with the present invention, a process and apparatus for producing decorative synthetic coverings comprises, in part, means for applying or depositing powdered material onto a base without contact between the powder applying means and the base material. In a first embodiment of the present invention, the means for applying the powder consists of a screen printing frame having a mesh structure which is configured in accordance to a desired decoration or pattern, and through which the powders are distributed onto the base material. This first embodiment may be employed as a continuous process wherein the screen printing frame is a rotating roller, driven at a circumferential speed which is synchronized to the speed of the base material passing thereunder. An inner hopper having two lips, i.e., doctor blades, rub against the inner face of the roller thereby uniformly supplying powder over the length of the roller. By adjusting the spacing of the lips, it is possible to regulate the flow of powder as a function of (1) the rotational speed of the roller; (2) the size and shape of the mesh and (3) the fluidity of the powder. In the present invention, as a result of both the (1) absence of contact between the powder applying means and the base material, and (2) gravity deposition of the powder, the rate of application of the powders does not depend upon the volume released by the mesh, as is usually the case with screen printing frames which must be in contact with the base material in order to produce a pattern.

Consequently, by carefully regulating and choosing the mesh sizes along the generatrix of the screen printing roll, the quantity of powder which is to be deposited may be precisely metered therefrom.

By selectively superimposing one or more layers of powder, it is possible to obtain relief (3 dimensional) effects and also other special effects which vary in intensity, hue, depth, gloss and/or the iridescence of color.

The decorative coverings having a ceramic glaze appearance produced in accordance with the present invention may be provided on a base material which consists essentially of polyvinylchloride (PVC) having the usual additive ingredients, particularly stabilizers and plasticizers. When such a PVC base is used, preferable powders include polyester resin, polyamide, polyolefin, polyvinyl, polyurethane, polyacrylate, or a compatible mixture of the above mentioned resins. The particular powder chosen will generally have a selected color and will therefore contain certain inorganic or organic pigments or colorants. In the case of organic pigments or colorants, it may be appropriate to use those pigments which are stable at the temperature to which they will be subjected.

Still further special decorative effects may be obtained in accordance with the present invention by the use of powders having varying physical and chemical properties. These varying properties may include, for example, different melting points, viscosity (when hot), wettability, or other physical (diffusion and/or solubility) or chemical characteristics.

Still other decorative effects may be provided by incorporating into the powders certain substances which produce a heterogenity in the covering, particularly inorganic materials such as, for example, ground terracotta powder, textile fibers and the like.

The process and apparatus of the present invention is compatible with conventional known techniques for the preparation, production and finishing of floor and/or wall coverings. The present invention is particularly well suited for producing decorative designs or patterns on said floor or wall coverings. Thus, the particular pattern produced in accordance with the present invention can be completed or finished with still another pattern in accordance with a conventional (i.e, printing) technique. Note that the finished product can receive a wear coat which may be transparent or colored if desired. Note also that conventional techniques for producing three dimensional relief, i.e., by embossing or differential foam expansion, may also be combined with the process of this invention. Accordingly, the present invention does not exclude additional process steps utilizing known methods for screen printing with the aid of a plastisol.

As a result of the absence of contact between the base material and the powder applicator, the base material can be coated beforehand, either partially or completely, with liquid or paste in order to obtain still further decorative effects. As mentioned, if the decorative coating obtained in accordance with the present invention does not have the desired surface properties (i.e., wear, abrasion, indentation or scratching resistance), a suitable surface may be obtained by depositing a resistant coating.

After the pattern or decorative design has been applied onto the base material, the thermal treatment will provide at least a partial, fusion of the powder. Of course, care should be taken not to displace this pattern during the thermal treatment process. It has been found that heating by means of infrared radiation gives preferable results. It should be appreciated, however, that it is also possible to use other advantageous heating means such as, for example, directly heating the base material.

Through a selective choice of powders, it is possible to obtain a desired mattness. Thus, for example, a "Fully" fusible powder may be thermally treated during fusion to produce a brilliant glaze-like surface condition while a "slightly" fusible powder can be deposited at the tiling joints, in order to obtain a matt joint imitating cement. It is necessary, however, that the "joint" be fixed during the thermal treatment by a chemical reaction, slight fusion or by fusion of a component part of the powder deposited at the joints and/or by co-fusion with the base, in order to achieve adequate strength. Similarly, it is possible to incorporate an expansion or foaming agent in the powder in order to produce a foamable deposit wherein selected areas on the covering may have pronouced depth or height.

Moreover, it is possible to obtain certain effects by, prior to thermal fixing, subjecting the base having powdered deposited thereon to controlled disturbances of a mechanical, pneumatic or electrical origin (i.e., vibrations, air blowing or electrical field).

Referring now to FIG. 1, manufacturing apparatus for use in accordance with the process of the present invention is shown. In FIG. 1, the apparatus of the present invention comprises means for unrolling base material 6 shown generally at 1, means for applying powder shown generally at 2, an oven 3 for use during thermal treatment of the covering, a cooling zone 4 and a device 5 for rolling up and cutting the processed decorative covering.

Figure 3:
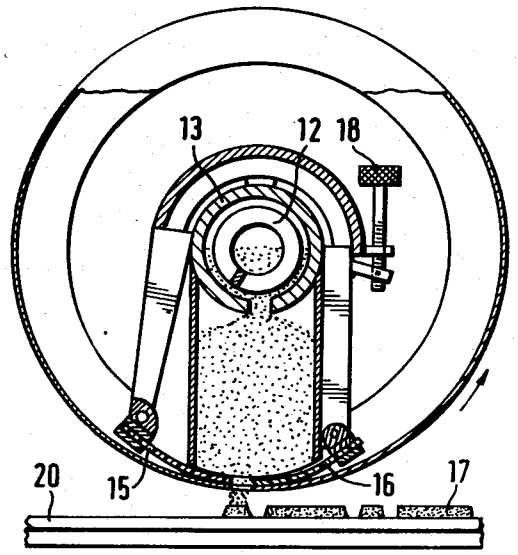
FIG. 3 is a cross-sectional elevation view of the roller of FIG. 2.
Figure 2:
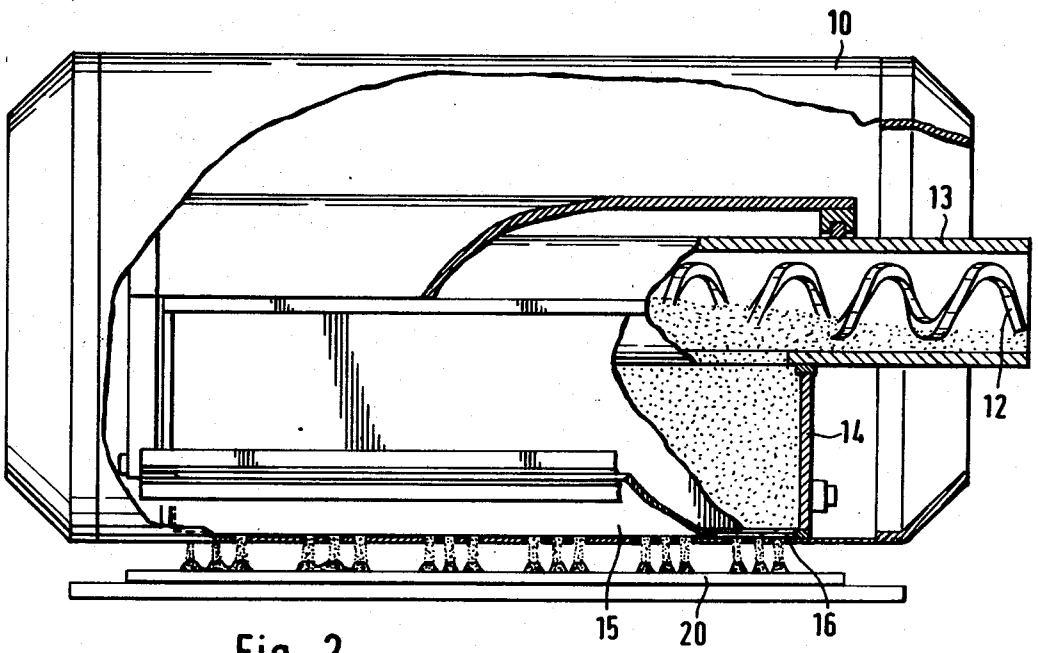
FIG. 2 is an elevation view, partly in cross-section, of a screen printing roller used in accordance with the process of the present invention.

In accordance with the present invention, the powder application means 2 comprises at least one roller of the type shown in FIGS. 2 and 3. It should be understood that while four rollers for applying powder are shown in FIG. 1, any number of rollers may be used with the present invention.

Still referring to FIG. 1, oven 3 is intended for the thermal treatment, i.e., co-fusion of the fusible components of the powder and the base. This co-fusion is preferably conducted at a temperature below the distortion temperature of the base, material usually about 200° C. The thermal treatment provides adhesion between the deposited powder and the base 6. The thermal treatment also provides smoothing of the powder surface (gloss) or at the least, the thermal treatment provides bonding between the individual grains of powder. Preferably, the heat source within the oven 3 is infrared radiation. As mentioned, oven 3 can also be used to heat the base material 6 so as to improve the adhesion or fixing of the powders thereto. It will be appreciated that an oven using any other means of heating, such as hot air, may similarly be used in accordance with the process and apparatus of the present invention.

Cooling zone 4 may consist of simply passing through free air over the base material (which has been coated with powders and fixed during treatment in the oven). Alternatively, the cooling can be accelerated and improved by a stream of cooled air using suitable cooling means such as water heat exchangers.

It should be understood that the cutting and rolling device 5 is well known to those skilled in the art and therefore does not require any additional description.

As shown in FIG. 1, the apparatus in accordance with the present invention does not involve any intermediate thermal treatment between the successive rollers 2. However, it should be understood that larger number of rollers may be used together with intermediate fixing or thermal treatment stages (i.e., slight heating of the base) between successive rollers.

Each of the four rollers 2 in FIG. 1 rotates at about the same circumferential speed. This speed is preferably equal to the linear speed of the base material 6 passing below the rollers. However, it should be appreciated that the rollers and the speed of the base material may differ, if desired, in order to produce certain special decorative effects.

It will be understood that the manufacturing apparatus shown in FIG. 1 may, of course, be integrated wholly or partially into a conventional production line for the manufacture of floor or wall coverings.

Referring now to FIGS. 2 and 3, a roller intended for the application of powders, commonly termed a rotary frame, is shown. The roller consists of a mesh screen 10 for screen printing, and a device for uniformly distributing powder. In this case, the uniform distribution device is a screw 12 which is capable of rotating in a feed channel 13. Screw 12 distributes the powder uniformly into a hopper 14 inside the roller. Two longitudinal lips or blades 15 and 16 (FIG. 3) are provided within the hopper 14 and are adjustably separated to a preselected distance. Blades 15 and 16 regulate the flow of powder which passes through the frame 10 in relation to (1) the speed of the rotating frame 10, (2) the fluidity of the powder, and (3) on the size of the mesh. As a result, deposits 17 of powder are formed at selected areas on the base material 20. Note that the separation of the lips 15 and 16 can be controlled by means of a screw 18 (FIG. 3).

In accordance with one embodiment of the present invention, the mesh screen 10 is comprised of a foraminous material whose shape, size and/or density varies according to the desired pattern or decorative design. Accordingly, as a result of the absence of contact and of gravity deposition, the powder flow will be greater or lesser at selected areas on the base material 6 depending upon the size of the mesh and consequently differences in the intensity of color and/or relief of the pattern will be easily effected.

The apparatus or equipment described in FIG. 1 is well suited for a continuous process. However, if a non-continuous process is desirable, a flat screen printing frame may be used, over which a hopper is provided having sliding lips (doctor blades) separated by a controllable distance.

The present invention may be better understood with reference to the following examples.

EXAMPLE 1

Figure 4:
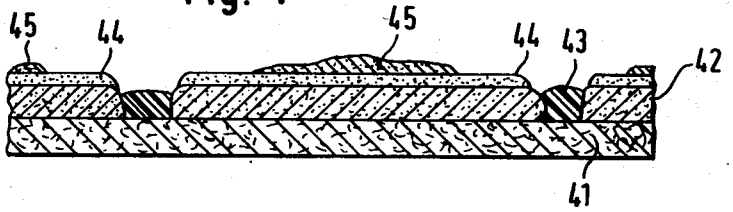
FIG. 4 is a cross-sectional elevation view of a typical wall covering in accordance with the process of the present invention.

Reference should be made to FIG. 4 in regard to the description of the first example of a wall covering in accordance with the process of the present invention. FIG. 4 is a cross-sectional view of a ceramic-like tiling design. The decorative pattern shown thereon consists of four successive deposits of powder, provided by a continuous production line in accordance with the apparatus of FIG. 1. Base 41 may be any suitable base material including, for example, stiffened paper coated with PVC, nonwoven fiber having a thermal setting binder and coated with PVC, a glass mat impregnated with PVC, or any other base material conventionally used for floor coverings and compatible with the particular powder employed.

In this example, the base material 41 consists of a glass voile with a weight of approximately 50 g/m$^2$, bonded with a thermosetting resin and coated with a plastisol having the formulation:

| | |
|---|---|
| PVC emulsion | 100 |
| Plasticizers | 65 |
| Ground calcite | 50 |
| Stabilizer | 2 |
| Pigments: titanium oxide and lampblack | 11.2 |
| Weight deposited approximately | 420 g/m$^2$ |
| Pregelling at 150° ± 15° C. | |

The powders are initially prepared by providing a base powder, preferably having no color, in a fast mixer of the PAPENMEIER type and within a heating and coolant vat.

The composition of the base powder is as follows:

| | |
|---|---|
| PVC suspension | 97 |
| Plasticizer | 40 |
| Stabilizer | 2 |
| Co-stabilizer | 3 |

The red tiling background 42 has the following composition:

| | |
|---|---|
| Dry powder | 100 |
| Chromophtal Red BRN (Ciba-Geigy) | 0.2 |

The matt, tiling joint 43 has the composition:

| | |
|---|---|
| Dry powder | 100 |
| Titanium oxide | 4 |
| Ground calcite | 3 |
| Lampblack | 0.5 |

The satin opalescent varnish 44 has the composition:

| | |
|---|---|
| Dry powder | 100 |
| Titanium oxide | 1.5 |

The glossy orange decorative design 45 has the composition:

| | |
|---|---|
| Dry powder | 100 |
| Chromophtal Orange 2G (Ciba) | 0.15 |

During the powder deposition, the four application rollers 2 are fed via their internal hoppers 14 using the four colored powders mentioned above.

The quantity of powder to be deposited is regulated by the opening of the lips 15, 16 of the inner hopper 14 so as to obtain the following mean thicknesses (after thermal treatment):

| | |
|---|---|
| Red tiling background 42: | 0.25 mm |
| Matt joint 43: | 0.25 mm |
| Opalescent varnish 44: | 0.12 mm |
| Glossy orange decorative design 45: | 0.20 mm |

The total weight of the deposit is approximately 500±30 g/m$^2$.

The total weight of the finished article is 500±30 g/m$^2$.

The thermal treatment, which consists of a cure, is preferably carried out as a single operation in an infrared oven 3 carefully controlled so as to rapidly produce a temperature in the order of 190° to 210° C. This thermal treatment should last approximately 45 seconds in order to achieve the thickness and the weight set forth above.

After leaving the oven, the tiling design is quickly cooled to at most, 50° C., whereupon it is rolled up.

In the case of a floor covering (as opposed to a wall covering), the above formula and operating procedures are substantially identical, the essential differences being in the base 41, which is more suitable for a flooring application.

EXAMPLE 2

In this example, the base is made from a fine metal sheet. This type of base can impart better insulative properties to the final product.

The base sheet used in this example is a sheet of 35-micron (±280 g/m$^2$) electrolytic copper from Yates Industries, one surface of which has been subjected to a treatment which increases the porosity.

The base powder and the coloring materials are prepared as in Example 1 and the decorative pattern is deposited as in Example 1. Unlike Example 1, the thermal treatment is slightly longer.

The adhesion of the decorative pattern to the base is a function of the porosity of the base (Table 1). For example, the adhesion is zero on a smooth surface. Some further values of adhesions are given as examples in Table 1. The adhesion between the base and pattern can be improved by providing a preliminary coating having a component which is compatible with the base and the PVC powder.

TABLE 1

| Copper sheet | Bonding Agent | Adhesion (daN/cm) |
|---|---|---|
| Porous face | — | 0.43 |
| Smooth face | — | 0 |
| Smooth face | EVAc | 0.40 |
| Smooth face | PU in solution | 0.32 |
| Smooth face | PU in solution | 1.24 |
| Smooth face | PU Latex | 0.88 |
| Smooth face | 2-component PU | 0.90 |

EXAMPLE 3

In this Example, the bases are chosen from a variety of paper bases which are typically used for floor and wall coverings.

The Examples were conducted with both uncoated bases and bases coated with a PVC plastisol. The formulation of the PVC plastisol is identical to that given in Example 1. The weight deposited is 150 g/m$^2$ and the coating is pregelled at 150° C.±15° C.

The base powder and the coloring materials are prepared as in Example 1. The decoration is deposited in the same manner. The thermal treatment is identical except that the coated bases do not affect the coloring of the decorative pattern.

EXAMPLE 4

In this Example, the decorative pattern is prepared and deposited as in the preceding Examples, but on an incompatible intermediate base (for example, silicone paper).

After the thermal treatment and subsequent cooling, the decorative pattern is separated from this intermediate base and deposited on a stable and compatible base material. The assembly is then subjected to a thermal treatment in an infrared oven which is regulated so as to rapidly increase the temperature to about 190° to 210° C. At the exit of the oven, the decorative article is rapidly cooled to less than 50° C. and then rolled. The resultant decorative sheet shows no distortions or stresses.

Alternatively, the base and the decorative pattern can be assembled on a machine known as a "combining" machine having a heating roller which is at a temperature of between about 120° and 150° C.

The advantages of the process and apparatus of the present invention may be summarized as follows:

The decorative synthetic covering of the present invention provides better dimensional stability to the final product. Thus, as there is no contact between the powder applicator means and the base material during application, and therefore no resultant pressure, there is consequently less pull on the base (which is only subjected to a fairly low driving tension).

The present invention provides increased flexibility in terms of the physical state of the base surface. This is in distinct contrast to the prior art wherein printing on a non-planar or pasty surface has been practically impossible. Indeed, the polymeric resin powder itself may even be deposited on a liquid base.

The process of the present invention also provides considerable savings in energy consumption since it is possible to produce a ceramic glaze effect at a temperature (200° C.) which is much lower than that temperature which is conventionally employed for glaze finishes. Moreover, the present invention permits successive deposits of materials on a single production line without pregelling or intermediate thermal fixing.

Because there is no contact between the powder applicant and the base, it is possible to provide a speed differential between the rotating rollers which apply the powder and the moving base material so as to create special and desirable distortion on the decorative pattern. Moreover, these distortions may be achieved without producing displacements, as is common in conventional superimposed printing patterns.

Another feature of the present invention is the enormous degree of flexibility in achieving a plurality of decorative effects. Thus, as mentioned, it is possible to mix several powders having different properties, i.e., hue, melting point, expansion coefficient and the like, so as to produce different degrees of mattness, inclusions, crazes and/or pitting caused, for example, by internal stresses or chemical adjuvants (as for imitation terracotta and the like).

The process of the present invention also makes it possible to produce imitation ceramic tiling which differs slightly from batch to batch, without having the repetition which accompanies conventional printing processes.

Finally, the desirable effects achieved by the present invention are not restricted to the imitation of ceramic materials, but the novel process disclosed herein may also produce imitations of textiles, particularly cloths or yarn, or even non-skid effects and the like.

It will be appreciated that in addition to floor and wall coverings, the products produced in accordance with the present invention may be broadly applied for use in connection with any decorative material.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A process for manufacturing synthetic decorative covering including the steps of:

depositing at least a first powder in accordance with a pattern onto a base, said powder being deposited onto said base under gravity by a continuous screen printing rotary frame, said powder being deposited in the absence of contact between said continuous screen printing rotary frame and said base, at least a portion of said powder containing particles which are fusible at a temperature below the distortion temperature of said base, said powder being compatible with said base, said rotary frame comprising:

a cylindrical frame, said frame being comprised of mesh screen, said mesh corresponding to a selected pattern;

uniform powder distribution means;

hopper means which accepts said powder after being uniformly distributed therein by said distribution means; and at least a pair of blade means, said blade means being adjustably separated, said blade means being in contact with said mesh screen wherein said blade means regulates the flow of the powder out of said rotary frame; and heating said powder to a temperature below the distortion temperature of said base wherein said powder is fixed to said base.

2. The process of claim 1 further comprising:

said powder at least partially penetrating into said base during said heating step.

3. The process of claim 1 wherein:

said base is an intermediate base and wherein said powder is heated on said intermediate base;

said powder being then transferred to a final base.

4. The process of claim 3 wherein:

said heating effects at least a partial co-fusion of said pattern with said final base.

5. The process of claim 4 wherein said final base is flexible.

6. The process of claim 1 wherein:

said heating effects at least a partial co-fusion of said pattern with said base.

7. The process of claim 6 wherein said base is flexible.

8. The process of claim 1 wherein said uniform powder distribution means comprises:

a feed channel; and a screw which rotates within said feed channel wherein said screw uniformly feeds powder into said hopper.

9. The process of claim 1 wherein said powder is a thermoplastic resin.

10. The process of claim 9 wherein said thermoplastic resin is at least one of the resins selected from the group consisting of:

polyester, polyamide, polyolefin, polyvinyl, polyurethane, and polyacrylate.

11. The process of claim 9 wherein said thermoplastic resin includes organic or inorganic pigments.

12. The process of claim 9 wherein said thermoplastic resin includes incompatible additives.

13. The process of claim 12 wherein said incompatible additives include inorganic materials or textile fibers.

14. The process of claim 1 wherein:

said heating effects a controlled co-fusion of the fusible components of said powder with at least a portion of said base.

15. The process of claim 1 wherein:

said heating is provided by infrared radiation.

16. The process of claim 1 wherein said heating is provided by hot air.

17. The process of claim 1 further including:

heating said base.

18. The process of claim 1 further including:

disturbing said base having powder deposited thereon prior to heating.

19. The process of claim 18 wherein:

said disturbance is controlled and wherein said disturbance is of a mechanical, pneumatic or electrical origin.

20. The process of claim 1 further including:

cooling said fixed powder subsequent to said heating step.

21. A process for manufacturing synthetic decorative covering including the steps of:

depositing at least a first powder in accordance with a pattern onto a base, said powder being deposited onto said base under gravity by a continuous screen printing frame, said powder being deposited in the absence of contact between said continuous screen printing frame and said base, at least a portion of said powder containing particles which are fusible at a temperature below the distortion temperature of said base, said powder being compatible with said base;

depositing at least a second powder in accordance with said pattern on said base, said second powder differing from said first powder by at least one of the properties selected from the group consisting of: hue, melting point, wetability and coefficient of thermal expansion; and heating said powder to a temperature below the distortion temperature of said base wherein said powder is fixed to said base.

22. The process of claim 21 wherein:

said second powder layer is deposited as a layer over at least a portion of said first powder.

23. The process of claim 22 including:

heating said powder after said first and second layers have been deposited.

24. The process of claim 21 wherein:

said continuous screen printing frame is a rotary frame.

25. The process of claim 24 wherein:

said continuous screen printing rotary frame is:

a cylindrical frame, said frame being comprises of mesh screen, said resh corresponding to a selected pattern;

uniform powder distribution means;

hopper means which accepts said powder after being uniformly distributed therein by said distribution means; and at least a pair of blade means, said blade means being adjustably separated, said blade means being in contact with said mesh screen, wherein said blade means regulates the flow of the powder out of said rotary frame.

26. The process of claim 25 wherein said uniform powder distribution means comprises:

a feed channel; and a screw which rotates within said feed channel wherein said screw uniformly feeds powder into said hopper.

27. A process for manufacturing synthetic decorative covering including the steps of:

depositing at least a first powder in accordance with a pattern onto a base, said powder being deposited onto said base under gravity by a powder applicator means, said powder being deposited in the absence of contact between said powder applicator means and said base, at least a portion of said powder containing particles which are fusible at a temperature below the distortion temperature of said base, said powder being compatible with said base;

depositing at least a second powder in accordance with said pattern on said base, said second powder differing from said first powder by at least one of the properties selected from the group consisting of: hue, melting point, wetability and coefficient of thermal expansion;

depositing said second powder as a layer over at least a portion of said first powder; and successively heating said powder after each layer is deposited to a temperature below the distortion temperature of said base wherein said heated powder is fixed to said base.

28. An apparatus for manufacturing synthetic decorative covering including:

a continuous screen printing rotary frame for depositing at least a first powder in accordance with a pattern onto a base;

means for depositing said powder under gravity in absence of contact between said continuous screen printing frame and said base;

means for heating said powder to a temperature below the distortion temperature of said base wherein said powder is fixed to said base and whereby said continuous screen printing rotary frame comprises:

a cylindrical frame, said frame being comprised of mesh screen, said mesh corresponding to a selected pattern;

uniform powder distribution means;

hopper means which accepts said powder after being uniformly distributed therein by said distribution means; and at least a pair of blade means, said blade means being adjustably separated, said blade means being in contact with said mesh screen, wherein said blade means regulates the flow of the powder out of said rotary frame.

29. The apparatus of claim 28 wherein said uniform powder distribution means comprises:

a feed channel; and a screw which rotates within said feed channel wherein said screw uniformly feeds powder into said hopper.

30. The apparatus of claim 28 wherein said heating means is an oven.

31. The apparatus of claim 28 wherein:

said heating is provided by infrared radiation.

32. The apparatus of claim 28 wherein said heating is provided by hot air.

33. The apparatus of claim 28 including:

means for cooling said fixed powder.

34. The apparatus of claim 28 including:

belt means for continously passing said base beneath said powder applicator means at a predetermined linear speed.

35. The apparatus of claim 34 wherein:

said rotary frame rotates at the same circumferential speed as the linear speed of said belt means.

36. The apparatus of claim 34 wherein:

said rotary frame rotates at a different circumferential speed than the linear speed of said belt means.

37. The apparatus of claim 28 including:

means for winding and unwinding said base.

* * * * *